US007954270B2

(12) United States Patent
Bentley

(10) Patent No.: US 7,954,270 B2
(45) Date of Patent: Jun. 7, 2011

(54) REVERSIBLE RAIL FOR A FIREARM

(75) Inventor: James K. Bentley, Meridian, ID (US)

(73) Assignee: Krow Innovation, LLC, Meridian, ID (US)

( * ) Notice: Subject to any disclaimer, the term of this patent is extended or adjusted under 35 U.S.C. 154(b) by 0 days.

(21) Appl. No.: 12/612,885

(22) Filed: Nov. 5, 2009

(65) Prior Publication Data

US 2011/0099873 A1 May 5, 2011

(51) Int. Cl.
*F41C 23/00* (2006.01)
*F41A 35/00* (2006.01)

(52) U.S. Cl. ..... 42/71.01; 42/72

(58) Field of Classification Search ..... 42/71.01, 42/72, 73, 85, 90, 97
See application file for complete search history.

(56) References Cited

U.S. PATENT DOCUMENTS

| | | | | | |
|---|---|---|---|---|---|
| 836,851 | A * | 11/1906 | Alves | 42/71.01 |
| 1,913,841 | A * | 6/1933 | Lowe | 42/85 |
| 2,112,577 | A * | 3/1938 | Roberts | 42/85 |
| 2,116,618 | A * | 5/1938 | Crockett | 42/85 |
| 2,933,843 | A * | 4/1960 | McFeeter | 42/85 |
| 4,674,216 | A * | 6/1987 | Ruger et al. | 42/71.01 |
| RE39,465 | E * | 1/2007 | Swan | 42/71.01 |
| 2005/0268513 | A1 * | 12/2005 | Battaglia | 42/71.01 |
| 2007/0169393 | A1 * | 7/2007 | Frost | 42/124 |

* cited by examiner

*Primary Examiner* — Bret Hayes
(74) *Attorney, Agent, or Firm* — Zarian Midgley & Johnson PLLC

(57) ABSTRACT

A mounting rail for a firearm is disclosed. The mounting rail may be a picatinny rail, a weaver rail, or the like, which allows tools such as lights or lasers to be attached to a firearm. The mounting rail is reversible and may be mounted within a portion of the firearm, such as the forend. The other side of the rail may match the finish and texture of the firearm so that the mounting rail is hidden from view when reversed.

21 Claims, 4 Drawing Sheets

REVERSIBLE RAIL FOR A FIREARM

BACKGROUND

1. Field of the Invention

The present application relates generally to firearms and more specifically to a mounting rail that may be used with a firearm.

2. Description of the Related Art

Mounting rails, such as picatinny rails and weaver rails, are typically used on firearms to mount accessories such as scopes, lasers, or bipods. Mounting rails may be connected to different portions of a firearm, such as a forend, an end stock, a barrel, a receiver, or another suitable portion, and are typically permanently or semi-permanently secured to the firearm. A mounting rail may be removed from the firearm if it is not in use and/or not expected to be used. Typically, a removed mounting rail is stored in a case or in another suitable place away from the firearm.

A shooter may choose to take a mounting rail off a firearm, for example, to reduce the weight of a firearm, to change the look of a firearm, or to use the mounting rail on another firearm, among other reasons. While a mounting rail connected to the forend of the firearm may allow for the connection of an accessory such as a light, it may also interfere with the hand placement of a shooter, which may make the firearm less comfortable and/or safe to use.

The present disclosure is directed toward overcoming, or at least reducing the effects of one or more of the issues set forth above.

SUMMARY

An embodiment of a reversible rail is disclosed. The reversible rail may comprise a first side, which may include a mounting rail, and a second side, which may have a texture and a contour. The reversible rail may be configured to be connected to a firearm in a first orientation and in a second orientation. The first orientation may be with the first side exposed and the second side partially inserted into a recess of a portion of the firearm. The second orientation may be with the second side exposed and the first side at least partially inserted into the recess. The reversible rail may further comprise at least one opening in the reversible rail, the opening including a constriction. The texture of the second side may substantially match a texture of the portion of the firearm. The contour of the second side may substantially match a contour of the portion of the firearm. The mounting rail may be a picatinny rail, a weaver rail, or a universal rail. The portion of the firearm may be a forend.

An embodiment of a forend of a firearm is disclosed. The forend may comprise an outer surface having a texture and a contour, a recess extending from the outer surface toward an inner surface of the forend, and a reversible rail. The reversible may have a first side with a mounting rail and a second side. The reversible rail may be configured to be installed in the recess. The reversible rail may be adapted to be installed in the recess with the mounting rail partially within the recess. The reversible rail may be adapted to be installed in the recess with the second side partially within the recess and with the mounting rail accessible for mounting an accessory. The second side may have a texture that is substantially the same as the texture of the outer surface of the forend. The second side may have a contour that matches the contour of the outer surface of the forend. The forend may be a portion of a firearm stock. The mounting rail may be a picatinny rail, a weaver rail, or a universal rail.

An embodiment of a firearm is also disclosed. The firearm may comprise a portion having an outer surface and an inner surface, a recess in the portion, which may extend from the outer surface toward the inner surface, and a reversible rail, which may be configured to be inserted into the recess. The reversible rail may have a first side and a second side. The first side may include a mounting rail. The reversible rail may be configured to be connected to the firearm in a first orientation and second orientation. The first orientation may be with the first side exposed and the second side partially inserted into the recess. The second orientation may be with the second side exposed and the first side partially inserted into the recess. The mounting rail may be a picatinny rail, a weaver rail, or a universal rail. The portion may be a forend. The first side and the second side may be secured as a single piece, which may be with fasteners. The second side comprises an outer surface that substantially matches the outer surface of the portion. The mounting rail may be configured to connect to a laser, a light, a scope, a bipod, a monopod, a magazine storage mechanism, a forend, a pistol grip, and/or a recoil mechanism. The firearm may be a 0.22 caliber rifle.

These and other embodiments of the present application will be discussed more fully in the description. The features, functions, and advantages can be achieved independently in various embodiments of the claimed invention, or may be combined in yet other embodiments.

BRIEF DESCRIPTION OF FIGURES

Like reference numbers and designations in the various drawings indicate like elements.

DETAILED DESCRIPTION

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention, and it is to be understood that modifications to the various disclosed embodiments may be made, and other embodiments may be utilized, without departing from the spirit and scope of the present invention. The following detailed description is, therefore, not to be taken in a limiting sense.

Figure 1:
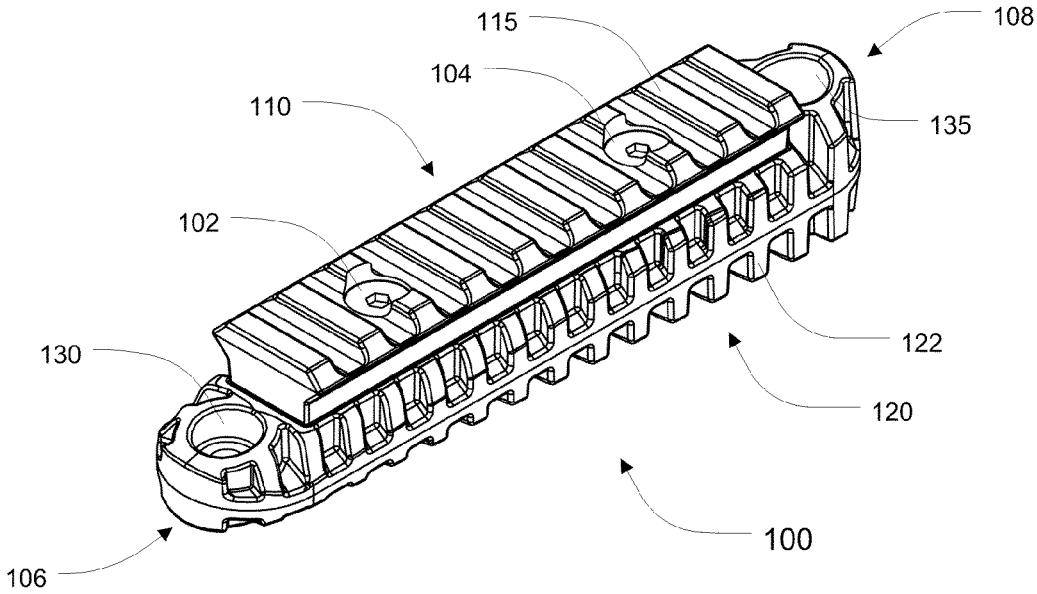
FIG. 1 is a perspective view of an embodiment of a reversible rail.

FIG. 1 is a perspective view of an embodiment of a reversible rail 100. The reversible rail 100 comprises a top side 110 which includes a mounting rail 115, such as a picatinny rail, weaver rail, or universal rail, and a bottom side 120 which includes an outer surface 122 which may have a texture or pattern formed into it. Additionally, a front opening 130 and a rear opening 135 are included in a front portion 106 and a rear portion 108 respectively. The front and rear openings 130, 135 extend from the top 110 through the bottom 120 of the reversible rail 100. Though the top side 110 and the bottom side 120 are named according to the illustration shown in FIG. 1, it would be apparent to one of ordinary skill in the art, given the benefit of this disclosure, that the top side 110 and the bottom side 120 could be reversed or name differently.

In the embodiment illustrated by FIG. 1, the reversible rail 100 comprises a top piece (embodied by the top side 110), and the bottom piece (embodied by the bottom side 120). Other embodiments of a reversible rail may be made as a single piece or may be made from more than two pieces, as would be apparent to one of ordinary skill in the art given the benefit of this disclosure.

Figure 2:
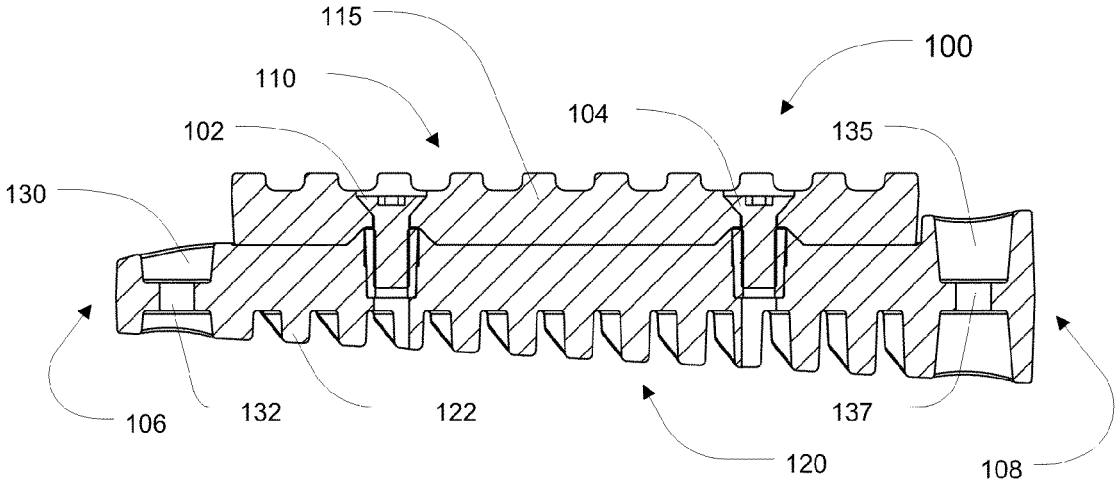
FIG. 2 is a cutaway side view of an embodiment of a reversible rail.

FIG. 2 is a cutaway side view of the reversible rail 100. As shown in FIG. 2, the top side 110 and the bottom side 120 are connected by a front fastener 102 and by a rear fastener 104. Also shown in FIG. 2, the front opening 130 includes a constriction 132. Similarly, the rear opening 135 includes a constriction 137. The constrictions 132 and 137 may allow reversible rail 100 to be secured to a firearm 300 by a front fastener 330 and a rear fastener 335, as best shown in FIG. 3C. The configuration of openings and fasteners are for illustrative purposes only as various elements could be used to secure the reversible rail to a firearm as would be appreciated by one of ordinary skill in the art having the benefit of this disclosure.

Figure 3A:
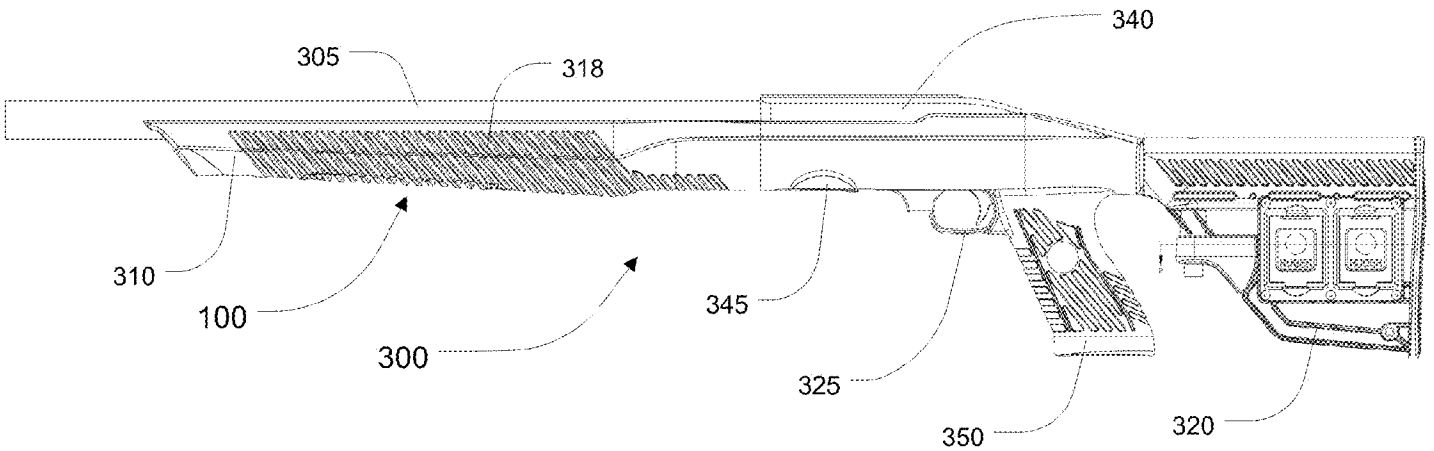
FIG. 3A is a side view of an embodiment of a reversible rail installed in a firearm with the mounting rail hidden.

FIG. 3A is a side view of an embodiment of a firearm 300, such as, for example, a Ruger 10/22, to which a reversible rail 100 may be connected. As illustrated in FIG. 3A, the firearm 300 comprises an end stock 320 that is connected to a receiver 340, which is further connected to a pistol grip 350, a trigger group 325, a forend 310, and a barrel 305. In the embodiment illustrated in FIG. 3A, the forend 310 and the pistol grip 350 are manufactured as a single piece; both the forend 310 and the pistol grip 350 are portions of a firearm stock. A detachable magazine 345 is also shown installed into the receiver 340. An embodiment of the reversible rail 100 may be connected to other firearms, such as other types of 0.22 caliber firearms, other caliber firearms, firearms without the pistol grip 350, and/or firearms without the detachable magazine 345, among other differences, as would be apparent to one of ordinary skill in the art, given the benefit of this disclosure. Further, such an embodiment may be connected to such other firearms with the mounting rail 115 hidden within a recess 316 and may have a matching outer surface 122.

Figure 3B:
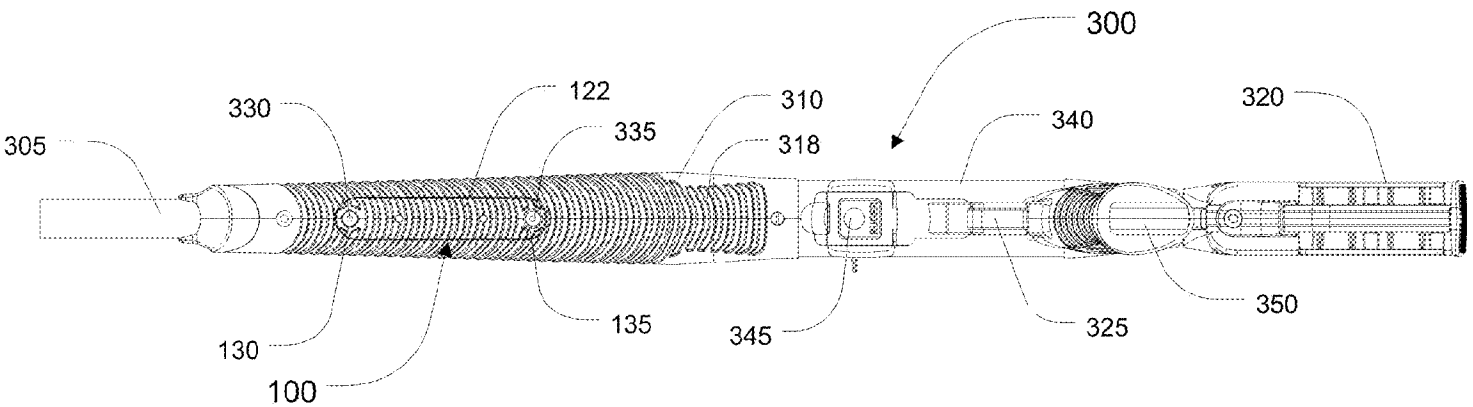
FIG. 3B is a bottom view of the embodiment of FIG. 3A.
Figure 3C:
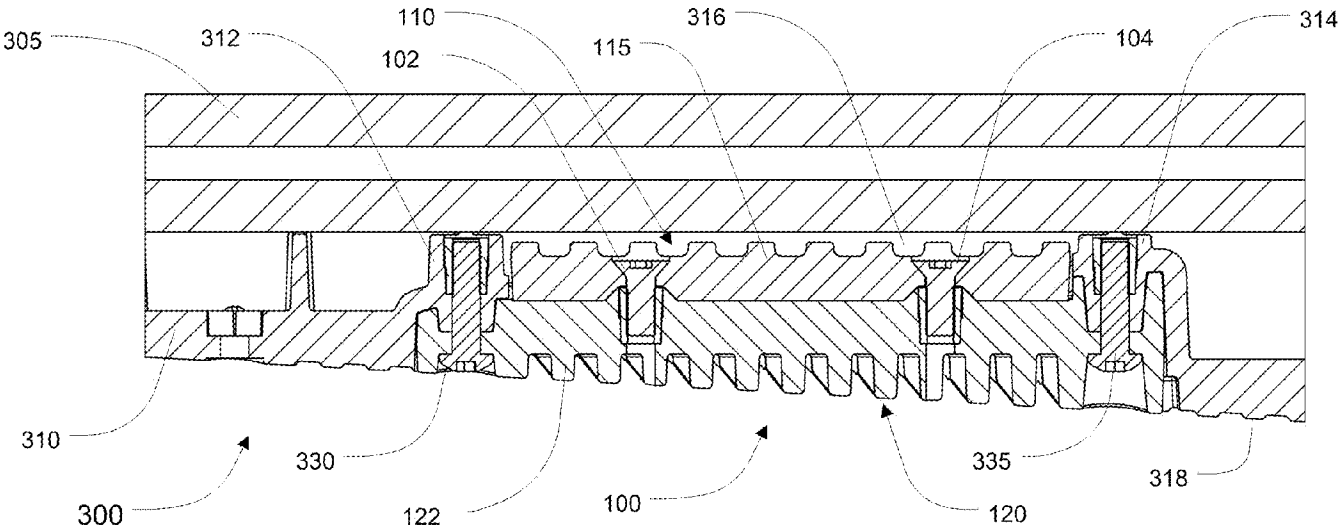
FIG. 3C is a close-up cutaway side view of an embodiment of a reversible rail installed in a firearm with the mounting rail hidden.

FIG. 3B is a bottom view of the embodiment of a firearm 300 illustrated in FIG. 3A. The reversible rail 100 is installed into a recess 316 (best shown in FIG. 3C) in the forend 310. The front fastener 330 is inserted through the front opening 130 to connect the front 106 to the forend 310. Similarly, the rear fastener 335 is inserted through the rear opening 135 to connect the rear 108 to the forend 310.

FIG. 3C is a close-up cutaway side view of the reversible rail 100 and the firearm 300. As illustrated by FIG. 3C, the reversible rail 100 is connected to the forend 310 by the front and rear fasteners 330, 335, which are installed through the front and rear openings 130, 135 and into a front forend profile 312 and a rear forend profile 314. Additionally, the front and rear forend profiles 312, 314 may act as an offset between the forend 310 and the barrel 305.

As shown in FIGS. 3A, 3B, and 3C the mounting rail 115 is hidden within the recess 316 of the forend 310, between the forend 310 and the barrel 305, and the outer surface 122 of the bottom 120 is exposed. The forend may comprise a texture or pattern formed into an outer surface 318 of the forend 310. The outer surface 122 of the reversible rail 100 may substantially match the texture or pattern of the outer surface 318. As such, when the reversible rail 100 is installed in the firearm 300 with the mounting rail 115 hidden within the recess 316 and the outer surface 122 is exposed, the reversible rail 100 may not be visually noticeable to a shooter or bystander. Additionally, as the forend 310 is a portion of the firearm upon which a shooter may grasp while shooting, the reversible rail 100, when installed with the mounting rail 115 hidden, may provide a comfortable shape for the shooter to grip, with a substantially continuous contour and substantially uniform texture with the forend 310. Alternatively, the bottom 120 may have a shape, texture, and/or pattern, that does not match the contour of the forend 310, as would be apparent to one of ordinary skill in the art, given the benefit of this disclosure.

Figure 4A:
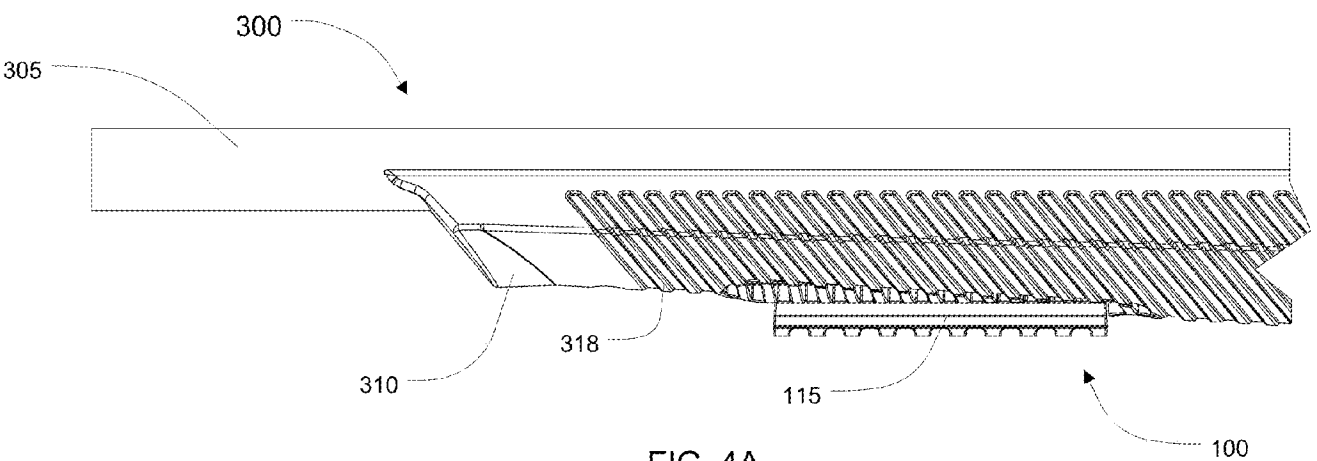
FIG. 4A is a side view of an embodiment of a reversible rail installed in a firearm with the mounting rail exposed.
Figure 4B:
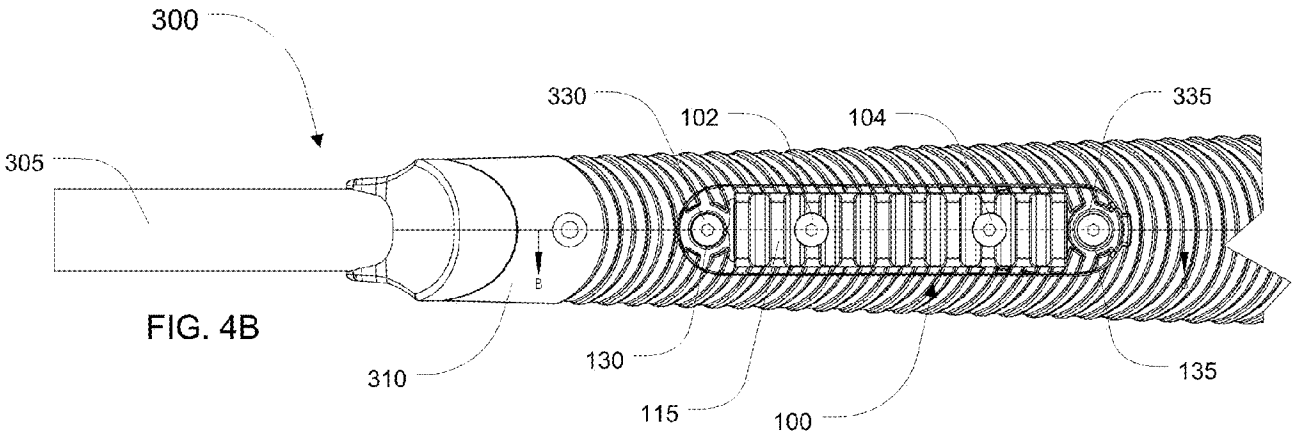
FIG. 4B is a bottom view of the embodiment of FIG. 3A.

FIG. 4A is a partial side view and FIG. 4B is a partial bottom view of the firearm 300 with the reversible rail 100 installed. The reversible rail 100 is installed in the forend 310 with the mounting rail 115 exposed (i.e. reversed with respect to FIGS. 3A, 3B, and 3C).

Figure 4C:
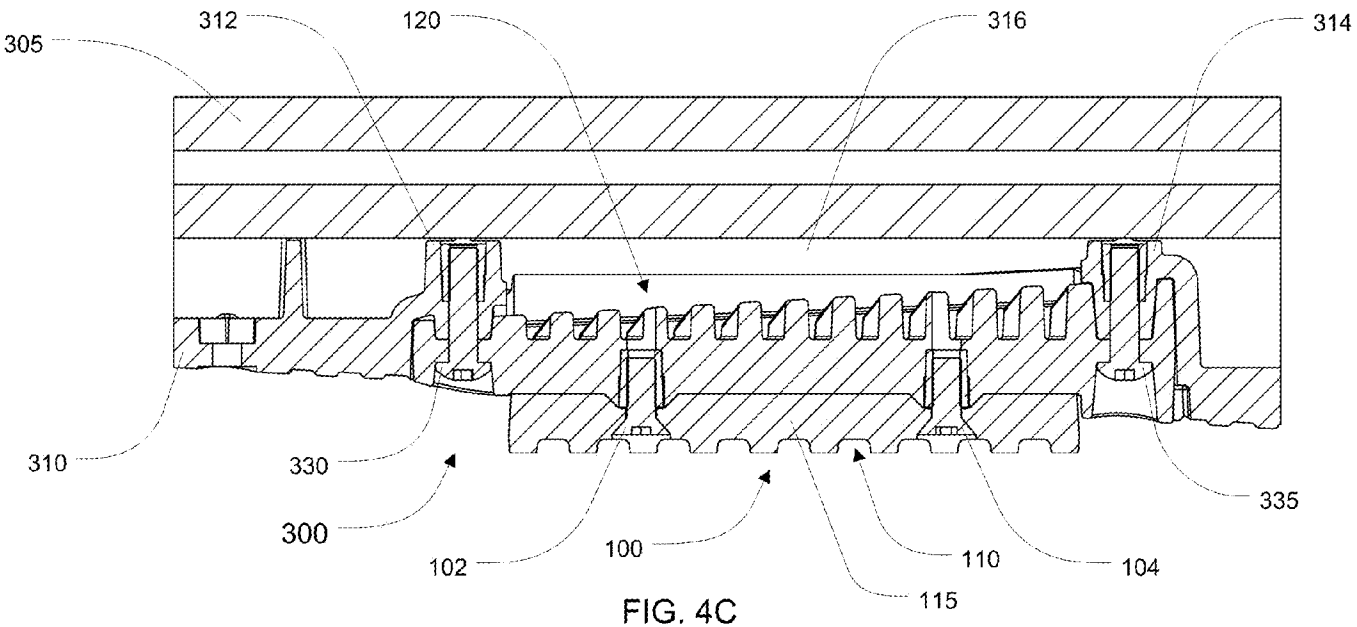
FIG. 4C is a close-up cutaway side view of an embodiment of a reversible rail installed in a firearm with the mounting rail exposed.

FIG. 4C is a cut-away side view of the reversible rail 100 installed in the forend 310 with the mounting rail 115 exposed. As illustrated by FIG. 4C, the front and rear fasteners 330, 335 may be used to connect the reversible rail 100 and the forend 310 when the mounting rail 115 is exposed.

In this position a firearm accessory, such as, for example, a light or a laser, may be mounted to the mounting rail 115, and thus to the firearm 300. Other rail mount accessories, such as a scope, a bipod, a monopod, a magazine storage mechanism, a forend, a pistol grip, a recoil mechanism, and/or other suitable accessories, may be mounted to the mounting rail 115, as would be apparent to one of ordinary skill in the art given the benefit of this disclosure.

To reverse the reversible rail 100, a user may remove the front and rear fasteners 330, 335 from the front and rear forend profiles 312, 314 and from the front and rear openings 130, 135 to disconnect the reversible rail 100 from the firearm 300. The reversible rail may then be removed from the recess 316 and flipped or reversed with respect to the firearm 300. Re-installation is the opposite of removal, with the reversible rail 100 being inserted into the recess 310 and the front and rear fasteners 330, 335 being installed into the front and rear openings 130, 135 and the front and rear forend profiles 312, 314 to connect the reversible rail 100 to the firearm 300.

Though the reversible rail 100 has been disclosed to fit within a recess 316 of a forend 310, it is further conceived that a reversible rail 100 may be similarly used with and/or connected to one or more other portions of a firearm 300, such as on the receiver or the end stock. Further, the reversible rail 100 may be connected in an alternate position on the forend 310, such as on the left and/or right sides of the forend 310, as would be apparent to one of ordinary skill in the art, given the benefit of this disclosure.

Although this invention has been described in terms of certain preferred embodiments, other embodiments that are apparent to those of ordinary skill in the art, including embodiments that do not provide all of the features and advantages set forth herein, are also within the scope of this invention. Therefore, the scope of the present invention is defined only by reference to the appended claims and equivalents thereof.

What is claimed is:

1. A reversible rail comprising:

a first side, the first side including a mounting rail; and a second side, the second side having a texture and a contour and not having a mounting rail, wherein the reversible rail is configured to be connected to a firearm in a first orientation and second orientation, the first orientation being with the first side exposed and the second side at least partially inserted into a recess of a portion substantially below a barrel of the firearm, the second orientation being with the second side exposed and the first side at least partially inserted into the recess, the reversible rail being configured so that at least a portion of the mounting rail is positioned out of the recess to be accessible for mounting an accessory when the reversible rail is connected to the firearm in the first orientation.

2. The reversible rail of claim 1, further comprising at least one opening in the reversible rail, the opening including a constriction.

3. The reversible rail of claim 1, wherein the texture of the second side substantially matches a texture of the portion of the firearm.

4. The reversible rail of claim 1, wherein the contour of the second side substantially matches a contour of the portion of the firearm.

5. The reversible rail of claim 1, wherein the mounting rail is a picatinny rail, a weaver rail, or a universal rail.

6. The reversible rail of claim 1, wherein the portion of the firearm is a forend.

7. The reversible rail of claim 1, wherein the reversible rail is attachable to either a left or right side of the portion of the firearm.

8. The reversible rail of claim 1, wherein the contour of the second side provides a comfortable shape for a shooter to grip.

9. A forend of a firearm having a barrel, the forend comprising:

a body, disposed substantially below the barrel;

an outer surface of the body having a texture and a contour;

at least one recess extending from the outer surface toward an inner surface of the body; and a reversible rail having a first side with a mounting rail and a second side without a mounting rail, the reversible rail being configured to be installed in the at least one recess and connected to the body, wherein the reversible rail is adapted to be installed in the at least one recess with the second side partially within the recess and with at least a portion of the mounting rail positioned out of the recess so as to be accessible for mounting an accessory when the reversible rail is connected to the body.

10. The forend of claim 9, wherein the reversible rail is adapted to be installed in the at least one recess with the mounting rail at least partially within the recess.

11. The forend of claim 9, wherein the second side has a texture that is substantially the same as the texture of the outer surface of the body.

12. The forend of claim 9, wherein the second side has a contour that matches the contour of the outer surface of the body.

13. The forend of claim 9, wherein the body is a portion of a firearm stock.

14. The forend of claim 9, wherein the mounting rail is a picatinny rail, a weaver rail, or a universal rail.

15. A firearm comprising:

a barrel;

a portion having an outer surface and an inner surface, disposed substantially below the barrel;

a recess in the portion, the recess extending from the outer surface toward the inner surface; and a reversible rail configured to be inserted into the recess, the reversible rail having a first side and a second side, the first side including a mounting rail and the second side not including a mounting rail, the reversible rail being configured to be connected to the portion in a first orientation and second orientation, the first orientation being with the first side exposed and the second side at least partially inserted into the recess, the second orientation being with the second side exposed and the first side at least partially inserted into the recess, the reversible rail being configured so that at least a portion of the mounting rail is positioned out of the recess to be accessible for mounting an accessory when the reversible rail is connected to the portion in the first orientation.

16. The firearm of claim 15, wherein the mounting rail is a picatinny rail, a weaver rail, or a universal rail.

17. The firearm of claim 15, wherein the portion is a forend.

18. The firearm of claim 15, wherein the second side comprises an outer surface that substantially matches the outer surface of the portion.

19. The firearm of claim 15, wherein the mounting rail is configured to connect to a laser, a light, a scope, a bipod, a monopod, a magazine storage mechanism, a forend, a pistol grip, or a recoil mechanism.

20. A method of exposing a mounting rail on a firearm, the firearm comprising a reversible rail attached to a portion of the firearm in a recess in the portion, the reversible rail comprising the mounting rail and being in a first orientation in which the mounting rail is enclosed in the recess so as to be unavailable for mounting an accessory, the method comprising:

removing the reversible rail from the recess in the firearm;

positioning the reversible rail in a second orientation in the recess so that the mounting rail is accessible for mounting an accessory; and attaching the reversible rail to the portion of the firearm in the second orientation.

21. The method of claim 20, wherein at least a portion of the mounting rail is positioned out of the recess when the reversible rail is attached to the portion of the firearm in the first orientation.

* * * * *